United States Patent [19]

Thompson

[11] 4,171,675

[45] Oct. 23, 1979

[54] CENTRIFUGAL PUMP AND PADDLE BOAT PROPULSION SYSTEM

[76] Inventor: Merall L. Thompson, P.O. Box 206, Lake Stevens, Wash. 98258

[21] Appl. No.: 857,296

[22] Filed: Dec. 5, 1977

[51] Int. Cl.[2] ..... B63H 11/02

[52] U.S. Cl. ..... 115/16; 115/11; 115/49; 60/221; 114/58

[58] Field of Search ..... 415/203, 206; 60/221, 60/222; 115/49, 50, 52, 53, 54, 11, 12 R, 14, 16; 114/58

[56] References Cited

U.S. PATENT DOCUMENTS

| | | | |
|---|---|---|---|
| 849,238 | 4/1907 | Hector | 115/52 |
| 3,034,295 | 5/1962 | Hanley | 115/12 R |
| 3,076,427 | 2/1963 | Stapleton | 115/16 |
| 3,155,071 | 11/1964 | Buttner | 115/16 |
| 3,224,408 | 12/1965 | Seredda | 115/12 R |
| 3,759,213 | 9/1973 | Quady | 115/49 |
| 4,004,544 | 1/1977 | Moore | 115/50 |

*Primary Examiner*—Trygve M. Blix

*Assistant Examiner*—D. W. Keen

*Attorney, Agent, or Firm*—Robert W. Beach; Ward Brown

[57] ABSTRACT

A radially vaned rotor is mounted for rotation about a horizontal axis extending athwartships of a boat. A housing encircles the major portion of the rotor and has an axial inlet and a downwardly directed peripheral outlet. The tips of the rotor vanes project through the housing peripheral outlet below the surface of the water surrounding the boat. When the boat is traveling at low speed, the rotor functions as the impeller of a centrifugal pump drawing water into the housing through the axial inlet and discharging the water through the peripheral outlet to propel the boat. The outlet can be shifted circumferentially fore and aft to alter the direction of water discharged therethrough. At high speed, planing of the boat elevates the housing so that only air is drawn through its axial inlet and discharged through its peripheral outlet, the majority of boat-propelling force being produced by the paddle wheel action of the rotor vane tips.

9 Claims, 8 Drawing Figures

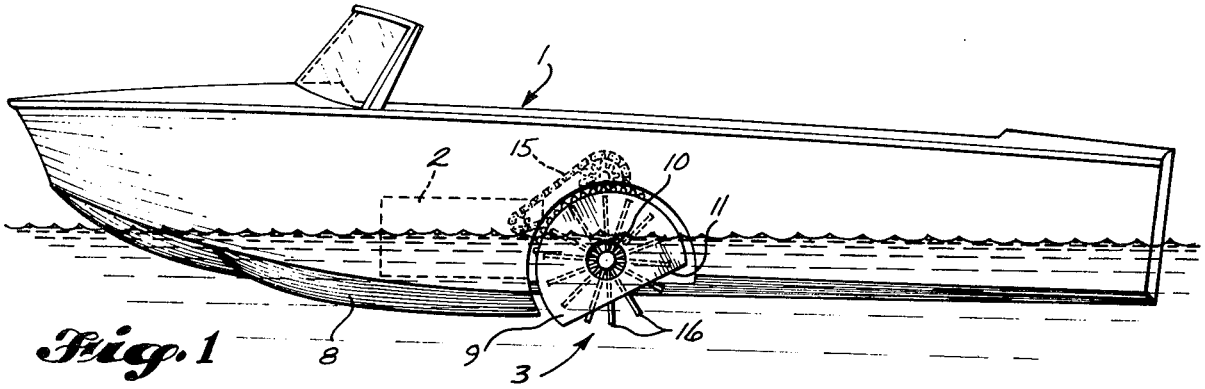
Fig. 1
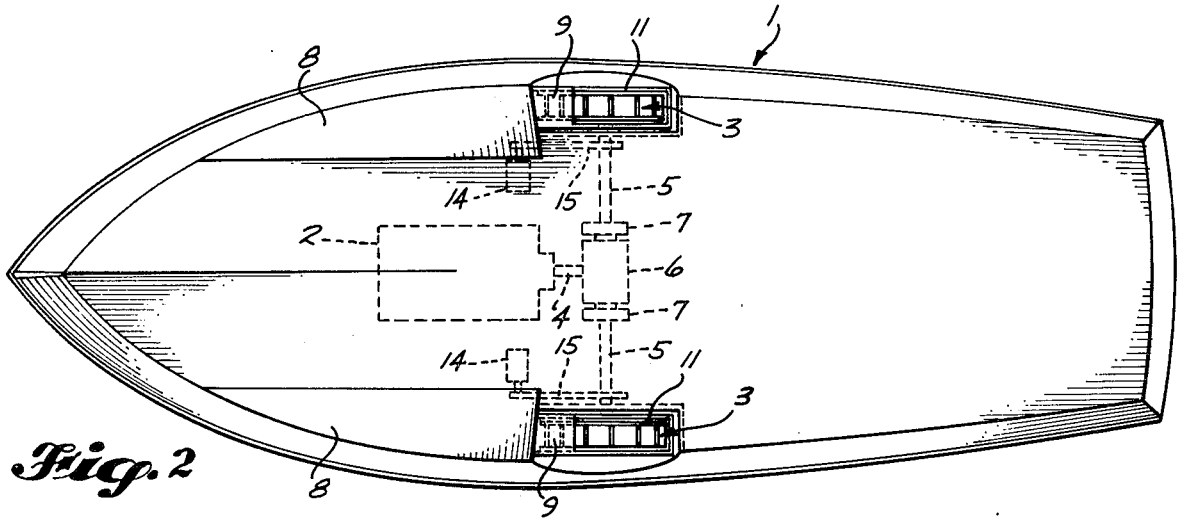
Fig. 2
Fig. 3
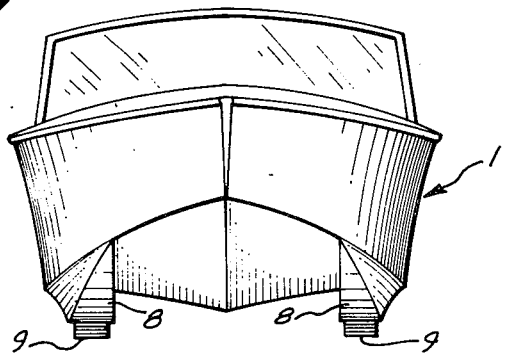
Fig. 4
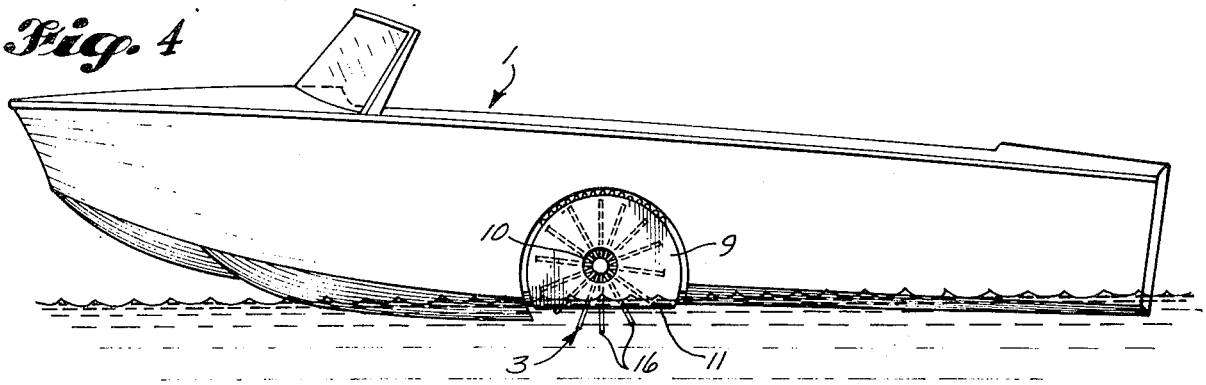

CENTRIFUGAL PUMP AND PADDLE BOAT PROPULSION SYSTEM

BACKGROUND OF THE INVENTION

1. Field of the Invention

The present invention relates to a boat propulsion system in which a radially vaned rotor functions as the impeller of a centrifugal pump when the boat is traveling at low speed and as a paddle wheel when the boat is traveling at high speed.

2. Prior Art

Paddle wheel boat propulsion systems are usually of simple design and construction. Representative paddle wheel systems are shown in the following U.S. Pat. Nos.: Connison—2,672; Aldrich—2,709; Weber—1,241,065; Moore—4,004,544.

Centrifugal pump boat propulsion systems are more complex than paddle wheel systems but are particularly efficient at low speeds. Such systems are shown in the following U.S. Pat. Nos.: Burgin—3,128,740; Davis—3,348,514.

No boat propulsion system is known in which a radially vaned rotor functions as the impeller of a centrifugal pump at low boat speeds and as a paddle wheel at high boat speeds. More specifically, in no known paddle wheel system has a paddle wheel been mounted in a housing having an axial water inlet and a peripheral outlet so that the paddle wheel can function as the impeller of a centrifugal pump. Similarly, no centrifugal pump propulsion system is known in which an impeller is mounted for rotation about a horiziontal axis extending athwartships of a boat with the tips of the impeller vanes projecting below the water through a downwardly directed peripheral opening in the pump housing so that the impeller can function as a paddle wheel.

SUMMARY OF THE INVENTION

The principal object of the present invention is to provide an efficient boat propulsion system for both high speed and low speed operations.

In accordance with the principal object, it is an object to provide a boat propulsion system which combines the features of paddle wheel and centrifugal pump systems.

The foregoing objects can be accomplished by providing a radially vaned rotor mounted for rotation about a horizontal axis extending athwartships of a boat. The major portion of the rotor is encircled by a housing having an axial inlet and a downwardly directed peripheral outlet. The tips of the rotor vanes project through the housing peripheral outlet below the surface of the water surrounding the boat. When the boat is traveling at low speeds, the rotor functions as the impeller of a centrifugal pump drawing water into the housing through its inlet and discharging the water through its outlet to propel the boat. The outlet can be shifted circumferentially fore and aft to alter the direction of water discharged therethrough. At high speed, planing of the boat elevates the housing axial inlet above the surface of the water and only air is conducted to the rotor, the boat being propelled by the paddle wheel action of the rotor vane tips projecting through the peripheral housing outlet.

In an alternative embodiment of the invention, a scoop is provided for the housing axial inlet which scoop may be directed to conduct water or air so that either centrifugal pump or paddle propulsion may be selected no matter how fast or slow the boat is traveling.

BRIEF DESCRIPTION OF THE DRAWINGS

FIG. 1 is a side elevation of a boat having a propulsion system in accordance with the present invention, the boat being at rest.

FIG. 2 is a bottom plan of the boat of FIG. 1, and FIG. 3 is a front elevation of the boat of FIG. 1.

FIG. 4 is a side elevation of the boat of FIG. 1, shown traveling at high speed.

DETAILED DESCRIPTION

Figure 5:
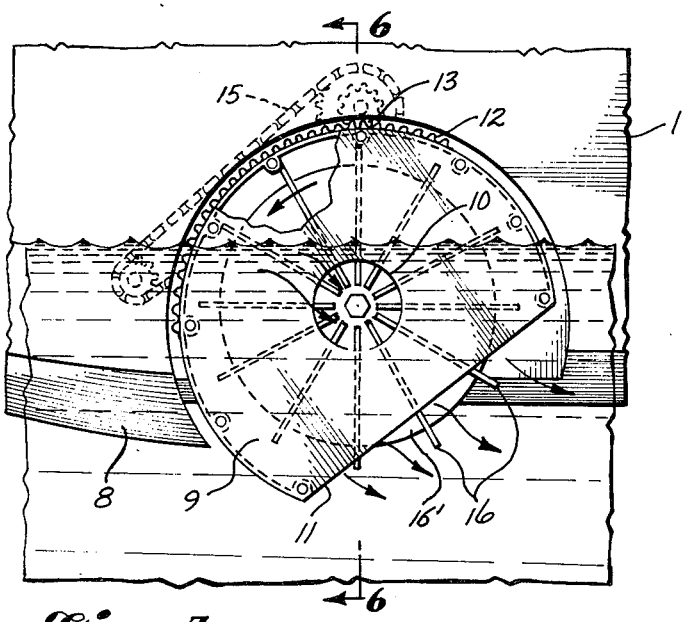
FIG. 5 is an enlarged side elevation of a fragment of the boat of FIG. 1.

In the form of boat propulsion system in accordance with the present invention shown in FIGS. 1 through 6, a boat 1 has an engine 2 for driving radially vaned rotors 3 located at opposite sides of the boat and rotatable about a horizontal axis extending athwartships of the boat. Rotary power is transferred from the engine to the rotors by an aftward extending drive shaft 4 connected to rotor axles 5 through differential gearing 6. Brakes 7 are used to control the relative speeds of rotation of the two rotors to steer the boat. Alternatively, or additionally, a conventional rudder could be used.

As shown in FIG. 3, the boat resembles a catamaran in that the hull includes a streamlined sponson 8 forward of each rotor. The rotors are positioned slightly aft of the center of gravity of the boat. However, it is contemplated that boat propulsion systems in accordance with the present invention could be used on boats of various designs. For example, one or more rotors of a size or sizes sufficient to give a desired propulsive force could be located at or near the center line of a boat which may or may not have sponsons.

Figure 6:
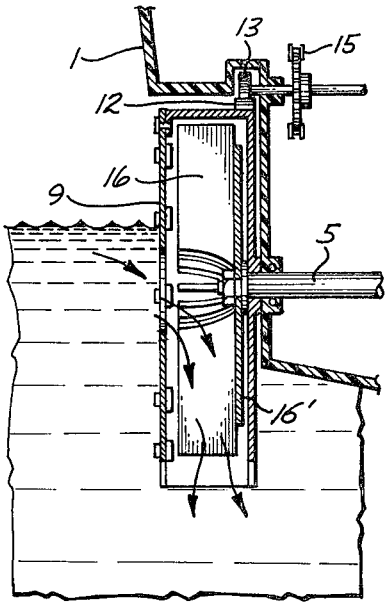
FIG. 6 is a section taken on line 6—6 of FIG. 5.

As best seen in FIGS. 5 and 6, the major portion of each rotor is encircled by a housing 9 having an axial inlet 10 and a downwardly directed peripheral outlet 11. In the embodiment shown in the drawings, the majority of the housing circumference is circular with a little more than one-quarter of the circle cut away by chordal outlet 11. So that the location of the housing outlet may be shifted, secured to the circular portion of the housing is a gear sector 12 which meshes with a gear 13 driven by a motor 14 through a chain and sprocket drive 15. A separate motor, chain and sprocket drive and gear sector is provided for each housing so that the housings are independently turnable.

Each rotor 3 includes radial paddles or vanes 16 mounted in cantilever fashion by their radial edges opposite the inlet 10 on a mounting disc 16'. The radially inward end of each vane is arcuately formed so that the rotor is shaped like the impeller of a centrifugal pump.

As shown in FIGS. 1, 5 and 6, when the boat is at rest the housing axial inlet 10 is below the waterline. Rotation of the rotor draws water into the housing generally axially of rotor 3 and discharges the water through the housing peripheral outlet 11. For maximum pumping efficiency, rotor 3 is disposed eccentrically of housing 9 away from the housing outlet so that the outward tips of vanes 16 are closest to the circumference of the housing when they are directly opposite the center of the housing outlet. If the rotor shown in FIG. 5 is rotated in a counterclockwise direction and the housing peripheral outlet is directed down and aft as shown, a forward propulsive force is exerted on the boat by the stream of discharged water. Rearward propulsive force may be effected by rotating the rotor in the opposite direction and directing the housing outlet down and forward of the boat.

As seen in FIG. 4, as the boat picks up speed and planes, housing 9 is turned to shift its outlet so that it is directed substantially directly downward. With the boat planing, the housing inlet is above the boat waterline and rotor 3 pumps only air. However, the tips of the rotating vanes project through the housing peripheral outlet below the water surrounding the boat and act as paddles to propel the boat. Preferably, the tip of a downwardly directed vane will extend below the lowermost portion of the boat hull.

Figure 7:
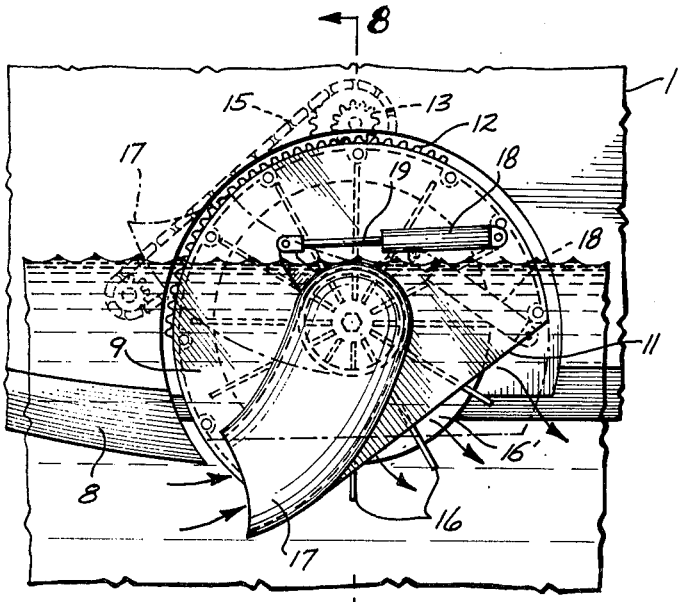
FIG. 7 is a side elevation of a fragment of an alternative form of boat propulsion system in accordance with the present invention.
Figure 8:
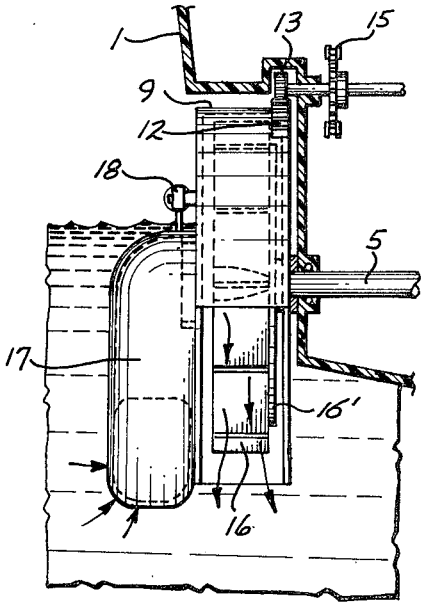
FIG. 8 is a section taken on line 8—8 of FIG. 7.

It may be desirable to shift from centrifugal pump propulsion to paddle propulsion before the boat picks up enough speed to raise the housing inlet above the waterline, or to continue centrifugal pump propulsion after the boat has planed. As shown in FIGS. 7 and 8, a swingable inlet scoop 17 may be provided for the housing inlet so that either centrifugal pump or paddle propulsion may be selected no matter how fast or slow the boat is traveling. In the embodiment shown in FIGS. 7 and 8, scoop 17 is swingable relative to housing 9 by a hydraulic cylinder 18 secured to the housing and having a double-acting plunger 19. As shown in solid lines in FIG. 7, when the housing outlet is directed down and aft as for forward centrifugal pump propulsion, plunger 19 is extended to assure that water is conducted to the rotor by the scoop opening facing forward to receive water by ram action. As shown in broken lines in FIG. 7, when the housing outlet is directed substantially directly downward as for paddle propulsion, the plunger is retracted to swing the scoop opening upward and assure that only air enters the rotor housing. Thus, either centrifugal pump or paddle propulsion may be selected at any time.

The relative sizes of the boat, rotors and hosuing axial inlets may vary for different boat designs. In a twenty foot boat of the general design shown in the drawings, two rotors, each of which is three feet in diameter and has the major portion of its circumference encircled by a housing having an eight inch circular inlet, provide sufficient propelling force to plane the boat when driven at 400 to 500 revolutions per minute. The rotor vanes should not be so close together so to impair paddle propulsion efficiency nor so far apart as to impair centrifugal pump propulsion efficiency. In the design discussed above, twelve radial vanes spaced equiangularly are provided as a preferred embodiment.

When a boat having a propulsion system in accordance with the present invention is traveling at low speed, centrifugal pump propulsion is used to provide high thrust. When the boat is traveling at high speed, only air is pumped to provide lift to decrease the drag of the boat, and the propelling force is provided principally by paddle propulsion. Consequently, a propulsion system in accordance with the present invention provides an efficient system for both low speed and high speed operations.

I claim:

1. Propulsion mechanism for a boat comprising a rotor mounted for rotation about a generally horizontal axis extending generally athwartships of the boat, said rotor having several centrifugal pump impeller vanes extending generally radially of said rotor, and a housing for said rotor closely encircling the major portion of the circumference of said rotor, said housing having an inlet located adjacent to the center of said rotor through which inlet water may be drawn into said housing generally axially and centrally of said rotor, the lower portion of said housing having a peripheral outlet through which water may be discharged from said housing by centrifugal pump action to propel the boat, said rotor being rotatable relative to said housing, the outer end portions of said rotor vanes being successively projectable downward through said housing peripheral outlet below water surrounding the boat by rotation of said rotor for operating as a paddle wheel to propel the boat.

2. The propulsion mechanism defined in claim 1, in which the downwardly directed rotor vanes extend below the lowermost portion of the boat hull.

3. The propulsion mechanism defined in claim 1, and means for shifting the housing peripheral outlet relative to the boat to alter the direction in which water is discharged therethrough.

4. The propulsion mechanism defined in claim 3, in which the shifting means shifts the housing peripheral outlet generally circumferentially of the rotor and generally fore and aft of the boat.

5. The propulsion mechanism defined in claim 4, in which the shifting means includes means for adjusting the housing circumferentially to swing its peripheral outlet about an axis extending generally athwartships of the boat.

6. The propulsion mechanism defined in claim 1, in which the rotor and housing are mounted on the boat so that the housing inlet is below the waterline when the boat is at rest and above the waterline when the boat is planing.

7. The propulsion mechanism defined in claim 1, and means for selectively conducting water or air into the housing through its inlet.

8. The propulsion mechanism defined in claim 7, in which the conducting means include a scoop for the housing inlet, said scoop being swingable to selectively conduct water or air into the housing.

9. Propulsion mechanism for a boat comprising a vaned rotor mounted for rotation relative to the boat, a housing including a circumferential portion closely encircling the major portion of the rotor circumference, said housing having an inlet through which water may be drawn into said housing generally axially of said rotor and a peripheral outlet through which water may be discharged from said housing to propel the boat, a scoop having a discharge end connected to the housing inlet, and means for swinging said scoop to selectively conduct water or air into said housing through its inlet.

* * * * *

UNITED STATES PATENT AND TRADEMARK OFFICE

CERTIFICATE OF CORRECTION

PATENT NO. : 4,171,675

DATED : October 23, 1979

INVENTOR(S) : Merall L. Thompson

It is certified that error appears in the above-identified patent and that said Letters Patent are hereby corrected as shown below:

Title page, [56] References Cited, cancel "Seredda" and insert --Sfredda--.

Signed and Sealed this

*Twenty-second* Day of *January 1980*

[SEAL]

*Attest:*

SIDNEY A. DIAMOND

*Attesting Officer*

*Commissioner of Patents and Trademarks*